United States Patent [19]

Fujikake

[11] 4,245,695

[45] Jan. 20, 1981

[54] HEAT TRANSFER TUBE FOR CONDENSATION AND METHOD FOR MANUFACTURING SAME

[75] Inventor: Jun Fujikake, Yamato-Kooriyama, Japan

[73] Assignee: Furukawa Metals Co., Ltd., Tokyo, Japan

[21] Appl. No.: 35,537

[22] Filed: May 3, 1979

[30] Foreign Application Priority Data

May 15, 1978 [JP] Japan ..... 53-57313

[51] Int. Cl.[3] ..... F28B 9/08; F28F 1/36

[52] U.S. Cl. ..... 165/133; 165/184

[58] Field of Search ..... 165/133, 110–111, 165/179, 181, 184; 62/285, 288, 290

[56] References Cited

U.S. PATENT DOCUMENTS

| | | | |
|---|---|---|---|
| Re. 30,077 | 8/1979 | Kun et al. | 165/133 |
| 3,326,283 | 6/1967 | Ware | 165/133 |
| 3,566,514 | 3/1971 | Szumigala | 165/133 |
| 4,040,479 | 8/1977 | Campbell et al. | 165/133 |
| 4,059,147 | 11/1977 | Thorne | 165/133 |
| 4,166,498 | 9/1979 | Fujie et al. | 165/133 |

FOREIGN PATENT DOCUMENTS

| | | | |
|---|---|---|---|
| 53-8855 | 1/1978 | Japan | 165/133 |

*Primary Examiner*—Sheldon Richter

*Attorney, Agent, or Firm*—Armstrong, Nikaido, Marmelstein & Kubovcik

[57] ABSTRACT

A heat transfer tube for condensation easily obtainable through an additional machining process applied to a low fin tube and a method for manufacturing the same. There is formed a toothed wheel-like part having mountain and valley parts alternately and continuously arranged on the outer circumferential fin part of the low fin tube. Each of the mountain parts is formed into a pyramid-like shape having a transverse cross section of approximately a long snare hand drum-like shape in which longer sides are disposed along grooves provided between the fins of the tube and are arranged to be concave curvatures each resembling an arc. The two slanting faces of the mountain part including these longer sides of the pyramid-like shape gradually and smoothly slant from the top of the pyramid to the bottom thereof. The heat transfer tube for condensation is manufactured by carrying out a transforming process applied to the outer circumference of fins of a low fin tube in the longitudinal direction of the fin tube.

4 Claims, 4 Drawing Figures

HEAT TRANSFER TUBE FOR CONDENSATION AND METHOD FOR MANUFACTURING SAME

BACKGROUND OF THE INVENTION

1. Field of the Invention

This invention relates to a heat transfer tube which is arranged to have improved performance when immersed in high temperature vapor to condense the vapor on a low temperature heat transfer face and also to a method for manufacturing the heat transfer tube.

2. Description of the Prior Art

Heretofore smooth tubes or low fin tubes have been used as heat transfer tube for condensers of refrigerators. Generally, in the initial stage of condensation, vapor condenses on a heat transfer face in a dewdrop-like state. However, the dropwise condensation becomes so-called film condensation as the condensation further proceeds until the heat transfer face is covered with a thick liquid film, which has a great thermal resistance to decrease heat transfer performance. This is a reason for poor heat transfer performance of the smooth tubes.

The low fin tube is provided with many fins which prevent the formation of a thick liquid film and increase the surface area of the tube for enhancement of heat transferring performance. Such advantageous effects attainable by the use of a low fin tube, however, has not been sufficient. In an attempt to further improve the heat transfer performance, there have been proposed new techniques. However, the new techniques proposed have not been satisfactory in economic aspect or in terms of easiness of handling of them.

In order to enhance the heat transfer performance during condensation, however, the surface of the heat transfer tube must be arranged to prevent the formation of a thick liquid film thereon and to readily remove condensed liquid therefrom as well as to increase the surface area of the heat transfer face.

SUMMARY OF THE INVENTION

The present invention is based on the above stated viewpoint. It is thus an object of the invention to provide a heat transfer tube for condensation in which the outer circumferential parts of fins of a low fin tube are arranged to present a toothed wheel-like configuration; each of the mountain parts is formed in a rectangular pyramid shape with each of the two slanting faces thereof corresponding to the longer sides of the bottom of the pyramid shape smoothly curved into a concave shape from the top of the mountain toward the bottom.

With the heat transfer tube formed into the above stated shape in accordance with this invention, the condensed liquid can be prevented from forming a condensed liquid film and is readily removable to enhance the heat transfer performance of the heat transfer tube. In addition to that, the heat transfer tube of the present invention is easily attachable to a heat exchanger; excels in an economic aspect; and also can be easily obtained by applying an additional machining process to a low fin tube.

The above and other objects and features of the present invention will appear more fully hereinafter from consideration of the following detailed description taken in connection with the accompanying drawing.

DETAILED DESCRIPTION OF PREFERRED EMBODIMENTS

Figure 1:
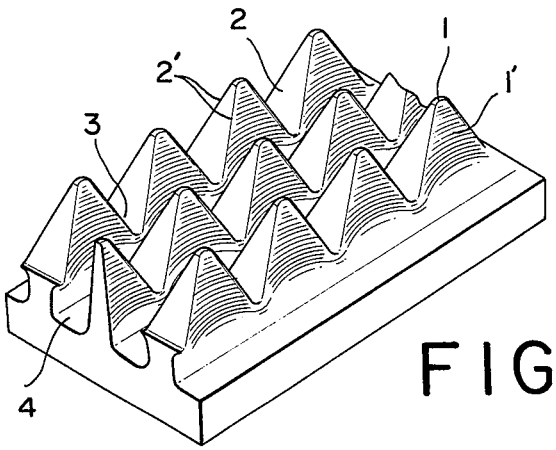
FIG. 1 is an enlarged oblique view showing a part of the surface configuration of a heat transfer face of the heat transfer tube of the present invention.

Referring to FIG. 1 which is an enlarged development view showing a heat transfer face, the outer circumferential fin part of a low fin tube is transformed to present a toothed wheel-like configuration consisting of mountain parts 1 continuously aligned alternately with valley parts 3 and are disposed, for example, in a helical manner.

Figure 2:
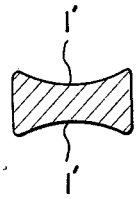
FIG. 2 is a transverse cross sectional view of each mountain part of the configuration taken in parallel with the bottom of the mountain part.

Each of the mountain parts 1 is in a pyramid shape which has a transverse cross sectional shape of something like a long snare hand drum as shown in FIG. 2. A pair of confronting slanting faces 1' which face the grooves 4 correspond to longer sides in this cross section of the pyramid shape shown in FIG. 1. Each of the slanting faces curves into a concave shape smoothly curving from the top of the mountain part to the bottom part thereof. The reference numeral 2 indicates a confronting pair of slanting faces which are facing the valley parts 3; and 2' indicates the ridgelines of the pyramid shaped mountain parts.

The depth of each valley part 3 is determined to be an optimum value according to the height from the top of the mountain part 1 to the bottom of the groove 4 and also to the pitch between one groove and another. Generally, however, the depth of the valley part 3 is set at a value not exceeding 70% of the height from the top of the mountain part 1 to the bottom of the groove 4.

In the present invention, the mountain parts in one circumferential or helical alignment of the mountain and valley parts may be alternately arranged side by side with valley parts in another circumferential or helical alignment of the mountain and valley parts which are disposed adjacent thereto, or the mountain parts in one circumferential or helical alignment may be regularly arranged side by side with the mountain parts in another circumferential or helical alignment which are disposed adjacent thereto. In other case, the mountain parts and valley parts in one circumferential or helical alignment may be respectively arranged at random with the mountain parts and valley parts in another circumferential or helical alignment which are disposed adjacent thereto.

Although the present invention is not limited to the helical side-by-side relative positional arrangement of the mountain and valley parts, it is preferable to have the alternate arrangement of the mountain and valley parts in the direction perpendicular to the grooves 4.

Also, the narrower the pitch between the grooves 4, the greater the effect will be.

The heat transfer tube for condensation of the present invention which has been described in the foregoing operates in the following manner: When the vapor condenses on the heat transfer face shown in FIG. 1, a condensed liquid flows over the slanting faces 1' and 2 and thus flows down into the grooves 4 while the surface tension and the gravity of the liquid are acting on the downward flow. As a result of this, a liquid film with which each mountain part 1 is covered becomes thin to reduce heat transfer resistance. Since the transverse cross sectional shape of the mountain part 1 is in a hand drum-like concave shape as shown in FIG. 2, the radius of curvature forming the concave shape and the surface tension of the liquid film cause a pressure gradient to be developed in the liquid film in the direction of the concave. By this, the liquid film is pulled toward the concave portion of the slanting face 1. As a result of this, the liquid film becomes thick at the concave portion and thin on both sides thereof. The area which has less resistance to heat transfer due to the thin liquid film becomes larger than the area in which the resistance to heat transfer is increased by the thick liquid film, so that excellent performance of condensation can be obtained as a whole. It is advantageous to have one alignment of the mountain and valley parts arranged in a alternate positional relation to another alignment of mountain and valley parts as shown in FIG. 1, because: If the mountain and valley positions in adjacent mountain-and-valley alignments are arranged to be the same, the valley part 3 which is the widest part in the direction of the pitch between adjacent grooves 4 comes to be located side by side with valley parts of the adjacent mountain-and-valley alignments. Such arrangement makes the width of each space between the valley parts 3 narrower to hinder the flow and removal of the liquid.

The action of the heat transfer face is as described in the foregoing. When this heat transfer face arrangement is applied to an external surface of a heat transfer tube, the relation of the configuration of the heat transfer face to gravity changes in a complex manner with changes in position in the circumferential direction of the heat transfer tube. However, the above mentioned characteristic feature that the liquid film on the heat transfer face becomes thin as a whole remain unchanged despite of such changes. The heat transfer resistance, therefore, becomes small to ensure excellent condensing characteristic.

Figure 3A:
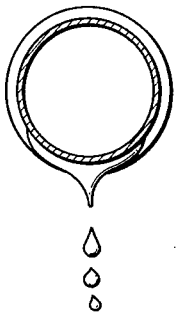
FIG. 3(*a*) and 3(*b*) are illustrations showing the conditions of liquid kept in a groove when the vapor of a refrigerant R-11 condenses on the surface of a low fin tube and that of the heat transfer tube of the present invention in comparison with each other.
Figure 3B:
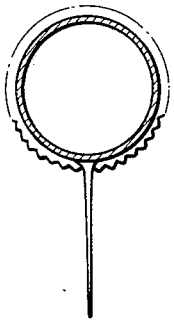

FIG. 3*a* and 3*b* show the observed conditions of liquid kept in grooves and its condition of removing therefrom when the vapor of a refrigerant R-11 condenses on the surface of a conventional low fin tube and that of the heat transfer tube of the present invention respectively. In the case of the conventional low fin tube, about $\frac{1}{3}$ of the circumference thereof has the groove filled with the liquid. This portion hardly contributes to condensing heat transfer while the liquid removes from the tube in a dripping manner. In contrast with this, in the invented heat transfer tube, a very small portion of the groove is filled with the liquid by virtue of the configuration provided on the heat transfer tube while the liquid vigorously leaves the tube in a continuous bar-like state indicating the excellent performance of condensation.

Next, the heat transfer tube for condensation of the present invention is manufactured by just installing a disc tool of a toothed wheel-like shape in the rear of a group of disc tools adapted for forming the fins of a low fin tube. The manufacturing process can be carried out in the same manner as in the process of manufacturing the ordinary low fin tubes and can be easily carried out following the low fin tube manufacturing process by machining the outer circumferencial fin part of the tube.

In the method for manufacturing the heat transfer tube for condensation of the present invention, when the outer circumferential fin part is subjected to a toothed wheel-like transformation machining process, the mountain parts 1 and the valley parts 3 are alternately and continuously formed into a configuration as shown in FIG. 1. Then, before the formation of each valley part 3, the fin portion which has been in the space of the valley part 3 is transformed by compression. A part of this fin portion is extended sidewise in the direction perpendicular to the original fin portion as illustrated in the form of the bottom of the valley part 3. The rest of the fin portion replaced by the valley part is transformed into a wide shape having the narrowest width at the top of the mountain part and having the width of it gradually increased therefrom to have the widest width in the vicinity of the bottom of the valley part 3.

On the other hand, in each portion of the fin that has been left as mountain part 1, the middle of the mountain part retains a shape which is close to the cross sectional shape of the original fin as it is less affected by the transformation by compression. However, since the slanting face 2 slanting to the valley part is formed into a wide shape the width of which gradually increases from the narrow top of the mountain to the bottom of the valley part as mentioned in the foregoing, the width between a confronting pair of slanting faces 1' of the mountain part gradually decreases as these faces slant toward the middle parts thereof. Therefore, the slanting faces 1' is obtained in a shape formed with the two slanting faces which are in parallel with the original fin portions of the mountain part 1 transformed into a concave shape which has a curvature closely resembling an arc. With a suitable pitch of the toothed wheel of the above stated toothed wheel-like disc tool selected, the mountain part 1 is formed into a pyramid-like shape the transverse cross section of which has a shape resembling a long snare hand drum, the cross sectional shape having longer sides facing the grooves 4 and having arcuate concave curvatures respectively.

The basic machining process of the present invention is carried out, as described in the foregoing, by using a fin forming machine either concurrently with or after a fin machining process. The heat transfer tube which is obtained in the above stated manner, however, has burrs or protrusions in most cases. It is, therefore, desirable to lightly apply a wire brush to the surface of the heat transfer tube in the last process of the manufacture thereof. Excessive brushing, however, would cause deformation, which then would results in lowered performance of the tube. The degree of the wire brushing process, therefore, should be determined based on results of experiments.

Experimental Example

By using a fin forming machine having three tool mounting shafts at a phase difference of 120°, a fin machining process was applied to a copper tube measuring 19.05 mm in outside diameter and 1.40 mm in thickness. A fin tube having three herical fin lines was obtained. The fin tube measured 18.87 mm in outside diameter, 16.03 mm in root diameter, 1.42 mm in fin height and 0.98 mm in fin pitch. The outside diameter of a disc tool used in the last stage of the fin forming process was 52.71 mm.

Next, a toothed wheel-like disc tool measuring 51.8 mm in outside diameter, having 120 teeth, the width of the tip of each tooth measuring 0.15 mm, the angle of each tooth tip being 60° and the width thereof measuring 0.7 mm, was attached to the fin forming machine, through a shim measuring 0.63 mm, behind the last stage disc tool of each of the three tool mounting shafts. Then, a transformation machining process was carried out concurrently with the fin forming process. By this, a heat transfer tube having a surface configuration similar to the surface configuration shown in FIG. 1 was obtained. The heat transfer tube measured 18.87 mm in outside diameter, 16.03 mm in root diameter, 1.41 mm in circular pitch and 0.75 mm in height of each mountain part with two slanting faces of the mountain curved into a concave shape respectively and disposed along grooves.

The mountain parts and valley parts which were helically arranged were located side by side in an approximately alternating manner with each other.

After the heat transfer tube which was obtained in the above stated manner was degreased, a brushing process was carried out on the tube at a working speed of 2 m/min with a steel wire brush measuring 0.15 mm in wire diameter, 250 mm in outside diameter and 30 mm in width.

Figure 4:
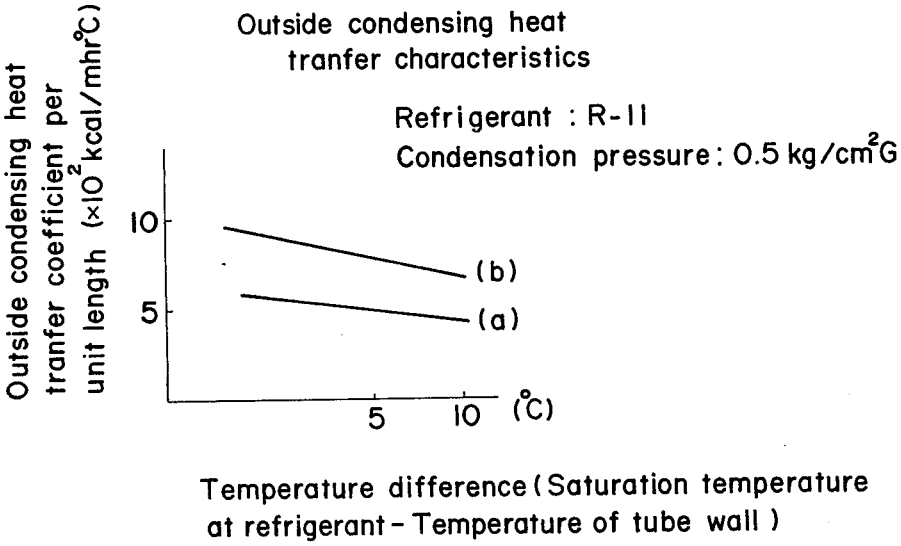
FIG. 4 is a graph showing a outside condensing heat transfer coefficient per unit length of a low fin tube at condensation pressure of 0.5 $kg/cm^2G$ of a refrigerant R-11 in comparison with that of the heat transfer tube of the present invention.

The outside condensing heat transfer coefficient per unit length of the above stated heat transfer tube per unit length thereof in the vapor of a refrigerant R-11 was as represented by a line (b) in FIG. 4.

Further, for the sake of comparison, the outside condensing heat transfer coefficient per unit length of the low fin tube which has fin pitch of 0.98 mm and to which the transformation process of the present invention was not applied is shown by another line (a) in FIG. 4.

The condensation pressure was 0.5 $kg/cm^2G$.

Advantageous Features of the Invention (1) As shown in FIG. 1, the heat transfer face of the heat transfer tube of the present invention was prepared by transforming the outer circumferential fin part of a low fin tube into a toothed wheel-like configuration. The approximate shape of each part that corresponds to a mountain part of a toothed wheel is a rectangular pyramid. The bottom of the pyramid has longer sides along continuous grooves. The two slanting faces corresponding to these longer sides gradually curve from the top of the mountain part to the bottom thereof to form a concave shape respectively. When the vapor condenses, the condensed liquid is prompted by this arrangement to flow from the slanting faces into the grooves while the surface tension and the gravity of the liquid are acting. With the liquid flowing in this manner, the liquid film covering the mountain part becomes thin to decrease resistance to heat transfer. Further, on each of the two slanting faces of the mountain part which are in a concave shape, the radius of curvature forming the concave shape and the action of the surface tension develop a pressure gradient in the liquid film toward the concave and the liquid film is thus pulled in the direction of the concave. This makes the portions of the liquid film on the areas on both sides of the concave thin, so that the resistance to heat transfer decreases as a whole. These actions thus greatly contribute to enhancement of the performance of the invented heat transfer tube.

(2) Compared with a low fin tube as shown in FIG. 3, the heat transfer tube of the present invention saliently excels in liquid removing performance. In the case of a low fin tube, about $\frac{1}{3}$ of grooves in the circumferential direction thereof are filled with liquid, which increases resistance to heat transfer to a great extent. Whereas, in the heat transfer tube of the present invention, the grooves are filled with the liquid to a much lesser degree, so that this also greatly contributes to the enhancement of the performance of the heat transfer tube.

(3) The heat transfer tube of this invention can be very easily attached to a heat exchanger in the same manner as a smooth tube or a fin tube.

(4) A desired heat transfer tube can be manufactured through almost the same simple machining process as a low fin tube forming process with a wire brushing process added for finishing as required, so that the manufacture can be carried out advantageously in terms of economy.

What is claimed is:

1. A heat transfer tube for condensation having a toothed wheel-like part which is formed in the outer circumferential fin part of a low fin tube to have mountain parts continuously arranged alternately with valley parts, each of the mountain parts having a transverse cross sectional shape in which longer sides face grooves provided between said fins and each of the longer sides is arranged to curve into a concave shape resembling an arc, each mountain part thus being in a pyramid shape which resembles the shape of a long snare hand drum, and two slanting faces of said pyramid shape including the longer sides being arranged to smoothly slant gradually from the top thereof to the bottom thereof.

2. A heat transfer tube for condensation according to claim 1, wherein the mountain parts in one circumferential or helical alignment of the mountain and valley are alternately arranged side by side with valley parts in another circumferential or helical alignment of the mountain and valley parts which are disposed adjacent thereto; or wherein the mountain parts in one circumferential or helical alignment are regularly arranged side by side with the mountain parts in another circumferential or helical alignment which are disposed adjacent thereto; or wherein the mountain parts and valley parts in one circumferential or helical alignment are respectively arranged at random with the mountain parts and valley parts in another circumferential or helical alignment which are disposed adjacent thereto.

3. A heat transfer tube for condensation according to claim 1, wherein the depth of said valley parts in said toothed wheel-like part formed on said outer circumferential fin part is set at a value not exceeding 70% of height from the top of said mountain part to the bottom of said groove between said fins.

4. A heat transfer tube for condensation according to claim 1, wherein said fins the outer circumferential part of which are formed into a toothed wheel-like shape are helically arranged side by side across said grooves provided between them; and, in this helical side-by-side arrangement of fins, the positions of said mountain and valley parts in the toothed wheel-like part of each fin relative to those of another fin are arranged to be such that, in the direction perpendicular to said grooves between the fins, said mountain parts are located alternately with said valley parts.

* * * * *